US007237367B1

(12) United States Patent
Sorkin

(10) Patent No.: US 7,237,367 B1
(45) Date of Patent: Jul. 3, 2007

(54) CONSTRUCTION CHAIR FOR USE WITH TILT WALL CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 596 days.

(21) Appl. No.: 10/688,184

(22) Filed: Oct. 20, 2003

(51) Int. Cl.
*E04C 5/16* (2006.01)

(52) U.S. Cl. ..... 52/687; 52/689

(58) Field of Classification Search ..... 52/677, 52/678, 679, 680, 681, 682, 683, 684, 685, 52/686, 687, 688, 689; 248/599, 600, 649, 248/440.1

See application file for complete search history.

(56) References Cited

U.S. PATENT DOCUMENTS 4,000,591 A * 1/1977 Courtois ..... 52/689
D271,847 S * 12/1983 Hernandez ..... D8/356
4,483,119 A * 11/1984 Hernandez ..... 52/689
4,682,461 A * 7/1987 Sizemore ..... 52/689
4,756,641 A * 7/1988 Hartzheim ..... 404/136
D334,133 S * 3/1993 Hartzheim ..... D8/354
5,555,693 A 9/1996 Sorkin
D388,312 S * 12/1997 Sorkin ..... D8/354
5,791,095 A * 8/1998 Sorkin ..... 52/105
6,557,317 B2 * 5/2003 Sorkin ..... 52/684
D480,291 S * 10/2003 Sorkin ..... D8/354
D482,262 S * 11/2003 Sorkin ..... D8/354

* cited by examiner

*Primary Examiner*—Carl D. Friedman
*Assistant Examiner*—Hunter Dreidame
(74) *Attorney, Agent, or Firm*—Egbert Law Offices

(57) ABSTRACT

A chair has a receiving area and a plurality of separate legs extending downwardly from the receiving area. Each of the separate legs has a first portion extending in an angle outwardly from the receiving area and a second portion extending from an end of the first portion opposite the receiving area. The second portion extends vertically downwardly or inwardly from the end of the first portion. The first portion has a length substantially greater than a length of the second portion.

12 Claims, 2 Drawing Sheets

CONSTRUCTION CHAIR FOR USE WITH TILT WALL CONSTRUCTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to chairs and spacers that are used in construction activities for the support of post-tension cables, rebars, or mesh. More particularly, the present invention relates to chairs of plastic construction that are used for the support of such materials in poured decks and precast work. Specifically, the present invention relates to chairs that are used in tilt wall construction.

BACKGROUND OF THE INVENTION

Chairs are commonly used in the construction industry for the support of post-tension cables, rebars, and mesh above a surface. Typically, when such materials are used, they must be supported above the surface when the concrete is poured. Chairs are used with poured decks, precast work, and slab-on-grade applications. In normal use, a receiving area formed on the chair will contact and support the rebar while the base of the chair rests on a deck or on a grade. When the concrete is poured, the chair will support the post-tension cable or rebar a proper distance above the bottom surface.

In deck applications, the most common chair that is employed is a metal chair manufactured by Meadow Steel Products of Tampa, Fla. This chair is made from a pair of bent wires. A first bent wire has a receiving area for the receipt of the rebar. The receiving area is bent into the wire so as to form a generally parabolic indentation. The ends of the wire are bent at a ninety degree angle so as to support the wire in an upright condition above the deck. A second wire is formed in an inverted U-shaped configuration and is welded to the bottom edge of the receiving area of the first wire. The second wire also has ends that are bent at generally ninety degree angles. The first wire will extend in a plane transverse to the second wire such that the first and second wire form the "legs" of the chair. The ends of each of these wires will rest on the deck while the table is supported. After the concrete has solidified, and the deck is removed, the bottom surfaces of the ends of the wire will be exposed. As such, it is necessary to coat the ends of the wires with an anti-rust material. The rebar can be tied to the receiving area.

In normal applications, this Meadow Steel Products' chair will support a single rebar above the deck for a desired distance. However, in other applications, it is often desirable to place a second smaller chair beneath the larger chair so that another additional rebar can be extended so as to intersect with the first rebar. The chairs come in a large number of sizes and heights. In some circumstances, it is often desirable to place more than one rebar into the receiving area of the chair. To accommodate this problem the receiving area of the chair has a generally parabolic indentation.

Corrosion and cost are major problems affecting the Meadow Steel Products' chair. In order to form such a chair, a great deal of manufacturing must take place, including metal forming, bending, dipping, and welding. These activities, along with the cost of the material used to form the chair, make the cost of the chair relatively expensive. If the Meadow steel chair is not coated, then corrosion can adversely affect the product. Such corrosion can occur even in coated metal chains.

In the past, many attempts have been made to create chairs of plastic material that can serve the purposes of the Meadow Steel Products' chair. In general, such efforts have resulted in plastic chairs that are ineffective, cumbersome to use, or unable to withstand the forces imparted by the cable upon the chair. In some cases, support rings and other structures have been placed upon the plastic chairs so as to give the chair sufficient strength. Unfortunately, as such structures are added to the plastic chair, it becomes increasingly difficult to tie the rebar to the receiving area of the chair. This often requires a threading of the wire through the interior of the plastic chair in order to tie the rebar. As a result of this complicated procedure, many construction workers have been unwilling to use such plastic chairs. Additionally, the interior structures and support rings of such plastic chairs eliminate the ability to extend the rebars in an intersected relationship since one chair cannot be stacked upon or over another.

The plastic chairs of the past have often broken, collapsed, or tipped over in actual use. In the case of the plastic chairs, the base of the chair has only a small area of contact with the deck. Even with the necessary internal structure, experience has shown that such plastic chairs fail to withstand the weight of the rebar.

One particular type of plastic chair that has had some success is manufactured by Aztec Concrete Accessories, Inc. of Fontana, Calif. This chair has a plurality of legs that extend downwardly from a central receiving area. The central receiving area has a generally semi-circular configuration that can receive only a single rebar. An annular ring extends around the legs of the chair so as to provide the necessary structural support for the chair. The feet of the chair extend inwardly of the ring. In use, these chairs have had a tendency to tip over. Additionally, these chairs fail to accommodate the need to align rebars in an intersected relationship. The use of the annular ring extending around the legs of the chairs requires that a wire must be threaded through the interior of the chair in order to tie the rebar within the receiving area. As such, these chairs have been generally ineffective for meeting the needs of the construction industry. In the past, these and other plastic chairs have been unable to withstand the loads placed upon them. As such, breakage and insufficient rebar support has resulted.

In the past, various U.S. and foreign patents have issued on various devices relating to chairs. For example, U.S. Pat. No. 4,000,591, issued on Jan. 4, 1977, to P. D. Courtois describes a holder adapted for supporting an anchor insert to be embedded into a concrete slab. The holder includes an enclosure, a plurality of legs extending from the enclosure, and a foot at the outer end of each leg and adapted with the remaining feet to support the enclosure in a spaced relationship above the floor of a concrete form. The enclosure includes a seat adapted for supporting an insert with the foot of the insert seated thereon. This holder device is not designed for the support of rebars in the concrete. British Patent No. 575,043, issued on Jan. 31, 1946, to K. Mattson, teaches a chair-like device that is intended for use in supporting a tendon above the floor of a slab. The support includes a clip formed at the receiving area so as to snap onto the exterior surface of a tendon. Various circular openings are formed in the body of this chair so as to allow tendons to be extended therethrough in parallel and transverse relationship. Australian Patent No. 227,969, published on Nov. 19, 1959, to Keith Douglas Moris describes a reinforcing chair which includes a plurality of legs extending downwardly from a cruciform receiving area.

Chairs present a particular problem when used in tilt wall construction. In such circumstances, the chairs are often referred to as "spacers" which are utilized in the forming of the walls of a building by using such concrete tilt-up structures. With prior art metallic rebar chairs, after the wall is poured and properly sets, all spacer and chair locations are checked for exposure of any portion of the chair at the surface of the wall. All of such exposed metallic edges are ground and then sealed to protect from the formation of rust, which attacks the metal of the rebar or chair on the interior of the wall, causing structural weaknesses. In addition, in tilt-wall construction, the metal from the chair can rust and eventually bleed into the concrete of the outer wall. This recreates an unsightly and unprofessional appearance of the concrete structure. As such, a need has developed so as to protect structure from the corrosion of chairs.

A particular problem associated with the use of such plastic chairs in tilt-up construction is the difference in coefficient of expansion of plastic as opposed to concrete. This is particularly the case when the separate chairs are sprayed with bond breaker compounds prior to the placement of the concrete upon the chairs. Bond breaker compounds are intended to break the seal that can be established between the form boards and concrete used for the formation of the wall. Often, the chairs are sprayed at the same time that the form is sprayed with the bond breaker. As a result, the chair will not adequately adhere directly to the concrete within the structure. Since plastic has a coefficient of expansion greater than the coefficient of expansion of the concrete, heat will tend to cause the plastic to expand for a greater distance than the concrete. As a result, the plastic chairs can expand so as to protrude outwardly of the wall subsequent to installation. This is particularly the case when the plastic chair has been coated with a bond breaker compound. As such, a need has developed so as to minimize the expansion of the chair relative to the concrete structure.

The present inventor is also the inventor of the subject matter of U.S. Pat. No. 5,791,095, issued on Aug. 11, 1998, and U.S. Pat. No. 5,555,693, issued on Jan. 12, 1995, for a "Chair for Use in Construction". Each of these prior patents describes a chair having a receiving area with a horizontal section and generally parabolic section extending transverse to the horizontal section. A plurality of separate legs extend downwardly from the receiving area. Each of the legs has a foot extending horizontally outwardly therefrom. The receiving area on the plurality of legs are integrally formed together of a polymeric material. The horizontal section and the generally parabolic section have a cruciform configuration. Each of the legs has a rectangular cross section in a horizontal plane.

In the chair described in U.S. Pat. Nos. 5,555,693 and 5,791,095 to the present inventor, a plurality of small pin members extends downwardly from the bottom surface of each of the feet of the chair. This pin surface has a pointed end and an inward end joined to the underside of the foot. This construction of a pin member created complexities during the injection molding of the chair. For example, the very small spaces used for the formation of such small pin members was difficult to develop. Additionally, since the pin members are directly connected to the underside of the foot, there is no supporting surface extending outwardly from the underside of the foot. As a result, the pointed end of the pin members could easily deflect and could be ineffective in properly grasping the underlying surface. Each of these prior art patents describes the use of three pin members on the underlying surface of each foot. Experiments with the product associated with these patents have indicated that fewer pin members than those indicated in these patents could achieve the same purpose of proper placement and holding capability as the three pin version.

It is an object of the present invention to provide a chair that is corrosion-proof and relatively inexpensive.

It is another object of the present invention to provide a chair that facilitates the ability to stack the chairs.

It is a further object of the present invention to provide a chair that withstands the forces imparted on it.

It is a further object of the present invention to provide a chair that is easy to manufacture and easy to use.

It is still another object of the present invention to provide a chair that has a receiving area that can accommodate several rebars.

It is another object of the present invention to provide a chair with a pin member extending outwardly from a bottom surface of the leg.

It is another object of the present invention to provide a chair which distributes the downward force of the weight of the rebar over a larger surface area.

It is a further object of the present invention to provide a chair for use in tilt wall construction which minimizes the adverse effects of thermal expansion upon the chair.

It is still a further object of the present invention to provide a chair which resist the adverse effect of the application of bond breaker to the chair.

These and other objects and advantages of the present invention will become apparent from a reading of the attached specification and appended claims.

BRIEF SUMMARY OF THE INVENTION

The present invention is a chair comprising a receiving area and a plurality of separate legs extending downwardly from the receiving area. Each of the plurality of legs has a first portion extending at an angle outwardly from the receiving area, and a second portion extending from an end of the first portion opposite the receiving area. The second portion extends vertically or inwardly from the end of the first portion.

In the present invention, the first portion has a length that is substantially greater than the length of the second portion. The first portion has an inner side and an outer side. The inner side extends at an greater angle with respect to vertical than an angle that the outer side extends with respect to vertical. The second portion also has inner side and outer side. The inner and outer sides of the second portion taper toward each other away from the end of the first portion. The second portion has a flat bottom surface opposite the end of the first portion. The leg further includes a pin member extending vertically downwardly from the flat bottom surface. This pin member is a single pin member having an inverted conical shape. The pin member has a point formed at an end thereof opposite the flat bottom surface.

The receiving area has a horizontal section and a generally parabolic section extending transverse to the horizontal section. Each of the plurality of legs is separated and unconnected to an adjacent leg other than at this receiving area. One of the plurality of legs extends downwardly from one end of the horizontal section. Another of the plurality of legs extends downwardly from an opposite end of the horizontal section. Still another of the plurality of legs extends downwardly from one end of the generally parabolic section. Finally, another of the plurality of legs extends downwardly from an opposite end of the parabolic section. In the present invention, the receiving area and the plurality of legs are integrally formed together of a nylon material.

The minimal length of the second portion will result in minimal expansion effects upon the portion of the chair adjacent to the outer surface of the wall. As a result, the present invention greatly minimizes expansion effects.

DETAILED DESCRIPTION OF THE INVENTION

Figure 1:
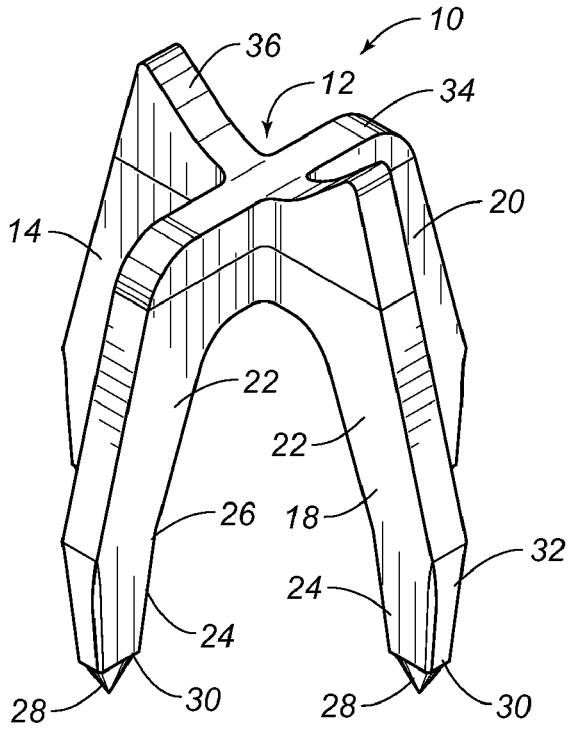
FIG. 1 is a perspective view showing the construction chair in accordance with the preferred embodiment of the present invention.

Referring to FIG. 1, there is shown the construction chair 10 in accordance with the preferred embodiment of the present invention. The chair 10 includes a receiving area 12, and a plurality of legs 14, 16, 18 and 20 extending downwardly from the receiving area 12. Each of the plurality of legs 14, 16, 18 and 20 is of generally identical configuration below the receiving area 12. In particular, each of the plurality of legs includes a first portion 22 extending outwardly at an angle away from the receiving area 12 and a second portion 24 extending from the end 26 of the first portion 22 opposite the receiving area 12. The second portion 24 extends vertically downwardly or inwardly from the end 24 of the first portion 22.

As can be seen in FIG. 1, the first portion 22 has a length that is substantially greater than a length of the second portion. A pin member 28 extends outwardly from the flat bottom surface 30 of the second portion 24.

In normal use, it can be seen that the first portion 22 has a substantially greater length than the second portion 24. Additionally, although the first portion 22 extends outwardly, the second portion 24 extends either vertically downwardly or inwardly. As a result, when the chair 10 is placed into the concrete, and after the concrete has solidified, any expansion effects will tend to cause the abutment of surfaces 32 of each of the legs 14, 16, 18 and 20 to abut the solidified concrete and to urge the expansion effects of the legs to be greatly absorbed by the extended length of the first portion 22. As a result, the receiving area 12 will tend to rise or lower within the concrete as a result of expansion effects. The pins 28 on the flat bottom surface 30 of the smaller second portion 24 will strongly resist the expansion forces or expand relatively minimally, as a result of the short length of such second portion.

The receiving area 12 has a horizontal section 34 and a parabolic section 36. The parabolic section 36 extends generally transverse to the horizontal section 34. Leg 16 extends downwardly from one end the horizontal section 34. Leg 18 extends downwardly from one end of the generally parabolic section 36. Leg 20 extends downwardly from an opposite end of the generally horizontal section 34. Leg 14 extends downwardly from an opposite end of the generally parabolic section 36 from leg 14. Leg 16 and 20 are in generally coplanar alignment. Similarly, legs 14 and 18 are in coplanar alignment. As can be seen, the legs 14, 16, 18 and 20 are separated from each other and are unconnected to an adjacent leg in an area below the receiving area 12. As a result, the present invention avoids the need to have any additional support structure located below the receiving area 12. It has been found, in the past, that any supporting structure, such as in the nature of rings, struts or structures located below the receiving area 12, would tend to create fall out within the concrete by having inadequate connection between the bulk of the concrete structure and that small portion of the concrete structure located in the area within the chair 10. As such, the present invention effectively avoids this fall out effect.

In the present invention, the receiving area 12, along with the legs 14, 16, 18 and 20 are integrally formed together of a nylon material. Experiments with the use of nylon material have shown that nylon material is a superior material to that of the cheaper polymeric material used with prior art chairs. It should be noted that nylon has moisture retention properties. Experiments have shown that the increased bond caused by nylon's moisture retention properties produces an increased life cycle index. This means that the chair 10 of the present invention provides greater durability and reduce maintenance costs when compared with chairs formed of other plastic material, such as polyethylene, polypropylene or polystyrene. The nylon fibers provide an isotropic reinforcement that proactively inhibits cracking and adds long term durability for equal or less cost. As such, the present invention provides unexpected benefits to the tilt wall construction through the use of such nylon material used for the formation of the chair 10.

Figure 2:
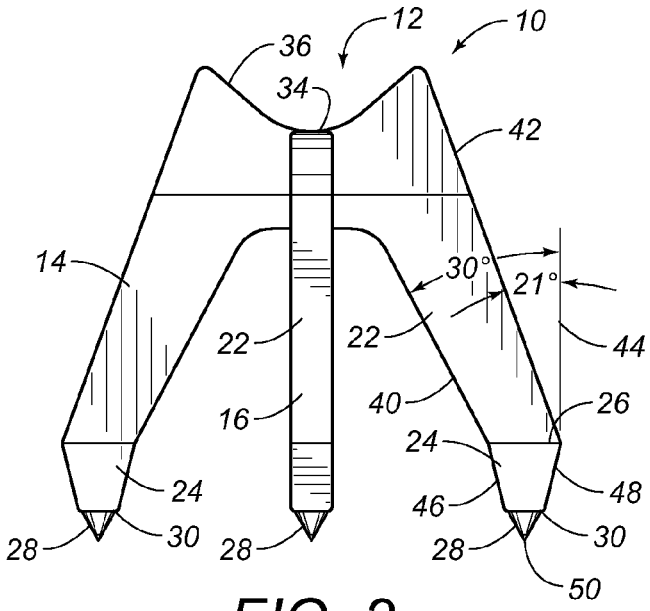
FIG. 2 is a side elevation view showing the construction chair of the present invention.

The particular configuration of the present invention is shown in FIG. 2. In particular, chair 10 is illustrated in side elevation view as having legs 14 and 18 located on one side of leg 16. It can be seen that leg 18 has an inner side 40 and an outer side 42. The inner side 40 is illustrated as extending at a 30° angle with respect to the vertical line 44. In contrast, the outer side 42 extends at only a 21° angle with respect to the vertical line 44. Leg 14 has a similar construction. The second portion 24 of leg 18 is also illustrated as having an inner side and an outer side 48. The inner side 46 and the outer side 48 taper toward each other away from the lower end 26 of the first portion 22. Flat bottom surface 30 is located at the end of the second portion 24 opposite the first portion 22. Pin member 28 extends vertically downwardly from the flat bottom surface 30. The pin member 28 is only a single pin member having an inverted conical shape. In particular, a point 50 is formed at an end of the pin member 28 opposite the flat bottom surface 30. As a result, each of the legs 14, 16, 18 and 20 will have only a minimal profile on the exposed surface of the wall upon which the chair 10 is placed.

Also illustrated in FIG. 2, it can be seen that the leg 16 has a generally rectangular cross-section in both the first portion 22 and the second portion 24. Leg 14 has an identical configuration to that of leg 18 but extends from an opposite side of the parabolic section 36 from leg 18.

Figure 3:
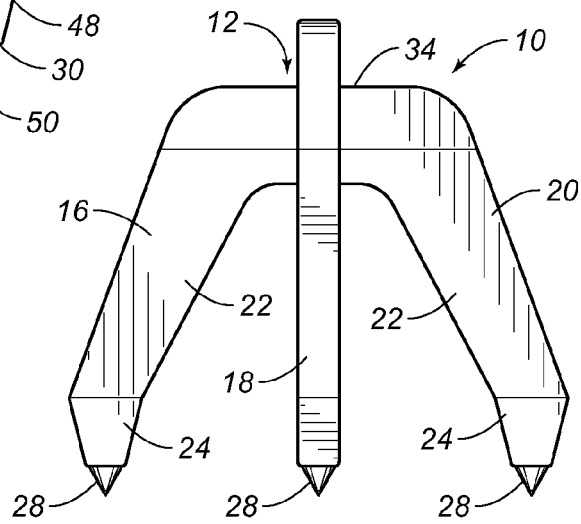
FIG. 3 is a frontal view showing the construction chair of the preferred embodiment of the present invention.

FIG. 3 shows a frontal view of the chair 10. In particular, in FIG. 3, it can be seen that the generally horizontal section 34 of the receiving area 12 extends at a lowermost point with respect to the generally parabolic section 36. Legs 16 and 20 extend downwardly from opposite sides of the generally horizontal section 34. Each of the legs 16 and 20 has an identical configuration to the legs 14 and 18, as described in association with FIG. 2. In particular, each of the legs 16 and 20 has a first portion 22 and a second portion 24 formed at an end of the first portion 22 opposite the receiving area 12. Pin member 28 extends downwardly from the bottom of each of the second portions 24.

Figure 4:
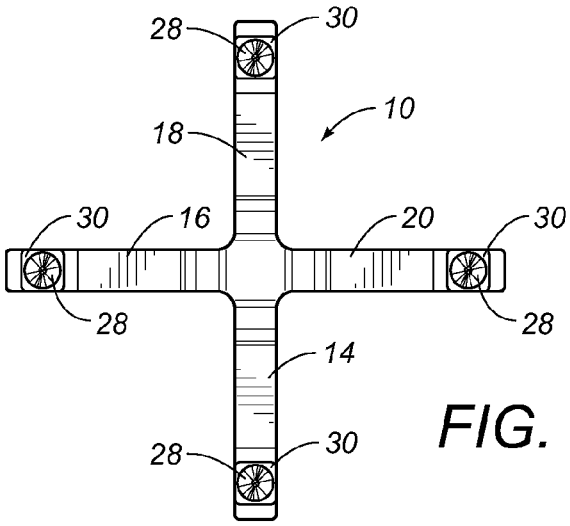
FIG. 4 is a bottom view showing the construction chair of the present invention.

In FIG. 4, it can be seen that the chair 10 has generally cruciform shape. The generally inverted conical shape of the pin members 28 is illustrated in FIG. 4. Each of the pin members 28 extends from the flat bottom surface 30 of each of the respective legs 14, 16, 18 and 20.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chair comprising:

a receiving area;

a plurality of legs extending downwardly from said receiving area, each of said plurality of legs comprising:

a first portion extending at an angle outwardly from said receiving area; and a second portion extending from an end of said first position opposite said receiving area, said second portion extending only vertically downwardly or inwardly from said end of said first portion, said second portion having a flat bottom surface opposite said end of said first portion, said first portion having an inner side and an outer side, said inner side extending at a greater angle with respect to vertical than an angle that said outer side extends with respect to vertical such that said inner side and said outer side converge toward said end of said first portion, said second portion having an inner side and an outer side tapering so as to converge at said flat bottom surface; and a pin member extending vertically downwardly from said flat bottom surface.

2. The chair of claim 1, said first portion having a length greater than a length of said second portion.

3. The chair of claim 1, said pin member being a single pin member of inverted conical shape.

4. The chair of claim 1, said pin member having a point formed at an end thereof opposite said flat bottom surface.

5. The chair of claim 1, each of said plurality of legs being separated from and unconnected to an adjacent leg other than at said receiving area.

6. The chair of claim 1, said receiving area having a horizontal section and a generally parabolic section extending transverse to said horizontal section.

7. The chair of claim 6, a first of said plurality of legs extending downwardly from one end of said horizontal section, a second of said plurality of legs extending downwardly from an opposite end of said horizontal section, and third of said plurality of legs extending downwardly from one end of said generally parabolic section, a fourth of said plurality of legs extending downwardly from an opposite side of said generally parabolic section.

8. The chair of claim 1, said receiving area and said plurality of legs being integrally formed together of a nylon material.

9. A chair comprising:

a receiving area; and a plurality of separate legs extending downwardly from said receiving area, each of said plurality of legs comprising:

a first portion extending at an angle outwardly from said receiving area;

a second portion extending from an end of said first portion opposite said receiving area, said first portion having a length greater than a length of said second portion, said second portion extending at an angle that is different than said angle that said first portion extends from said receiving area, said second portion having a flat bottom surface opposite said end of said first portion, said second portion extending only vertically downwardly or inwardly from said end of said first portion, said first portion having an inner side and outer side, said inner side extending at a greater angle with respect to vertical than an angle that said outer side extends with respect to vertical such that said inner side and said outer side converge toward said end of said first portion, said second portion having an inner side and an outer side, said inner and outer sides of said second portion converging toward said flat bottom surface; and a pin member extending vertically downwardly from said flat bottom surface.

10. The chair of claim 9, each of said plurality of legs being separated from and unconnected to an adjacent leg other than at said receiving area.

11. A chair comprising:

a receiving area; and a plurality of legs extending downwardly from said receiving area, each of said plurality of legs comprising:

a first portion extending at an angle outwardly from said receiving area;

a second portion extending at an end of said first portion opposite said receiving area, said second portion having a flat bottom surface opposite said end of said first portion, said second portion extending only vertically downwardly or inwardly from said end of said first portion, said first portion having a length greater than a length of said second portion; and a single pin member extending vertically downwardly from said flat bottom surface, said pin member being of an inverted conical shape and having a point formed at an end thereof opposite said flat bottom surface.

12. The chair of claim 11, each of said plurality of legs being separated from and unconnected to an adjacent leg other than at said receiving area.

* * * * *